United States Patent [19]

Reilly, Jr. et al.

[11] Patent Number: 4,961,454

[45] Date of Patent: Oct. 9, 1990

[54] INSULATED FOLDING DOOR

[76] Inventors: Paul J. Reilly, Jr., 2314 North Lincoln Park West, Chicago, Ill. 60614; Charles C. Harrett, Jr., 2456 Normandy, Apt. 305A, Grand Rapids, Mich. 49506

[21] Appl. No.: 872,805

[22] Filed: Jun. 11, 1986

[51] Int. Cl.[5] ..... A47H 5/00

[52] U.S. Cl. ..... 160/344; 160/199; 160/118; 160/349.1

[58] Field of Search ..... 160/84 R, 124, 126, 160/341, 344, 345, 349 R, 349 D, 330, 332, 199, 118

[56] References Cited

U.S. PATENT DOCUMENTS

| | | | |
|---|---|---|---|
| 1,762,576 | 6/1930 | Gray | 160/330 |
| 3,035,275 | 5/1962 | Strebeigh | 160/330 X |
| 3,321,003 | 5/1967 | Boerner | 160/330 X |
| 3,376,599 | 4/1968 | Singer | 160/84 R |
| 3,715,969 | 2/1973 | Burgess | 160/330 X |
| 4,083,395 | 4/1978 | Romano | 160/84 R |
| 4,141,611 | 2/1979 | DeLeon | 160/330 X |
| 4,142,570 | 3/1979 | Heimberg | 160/349 R |
| 4,142,931 | 3/1979 | Viol et al. | 160/84 R X |
| 4,274,467 | 6/1981 | Comeau | 160/84 R |
| 4,355,678 | 10/1982 | Romano | 160/332 |

*Primary Examiner*—David M. Purol

*Attorney, Agent, or Firm*—Foley & Lardner

[57] ABSTRACT

A folding door for industrial use utilizes a curtain having a series of spaced-apart panel sections which are insulated, and one or more folding hinge sections spanning adjacent panel sections. The hinge sections are generally made of flexible sheet material thinner than the insulated panel sections. Such a curtain is suspended from a doorway, and is opened and closed by folding and unfolding the curtain around the hinge sections. The folding door of the invention is particularly advantageous for use in large industrial refrigerators and freezers.

7 Claims, 2 Drawing Sheets

INSULATED FOLDING DOOR

FIELD OF THE INVENTION

This invention pertains to an insulated folding door particularly adapted for covering the entrance to an industrial refrigerator or freezer, and a curtain for use in such a door.

BACKGROUND OF THE INVENTION

A wide variety of doors have been designed for use in large industrial doorways. Such doorways are typically large enough to admit vehicles such as trucks. Conventional factory doors, however, are typically cumbersome and difficult to open and close rapidly. This led to the development of a variety of door designs providing doors which could be rapidly opened to admit a vehicle, or pushed open by a vehicle passing through.

Certain recent industrial doors utilize a series of flexible strips which hang down from the top of a doorway. The following patents and patent publications are illustrative of such designs: Schaefer U.S. Pat. No. 4,388,961 issued June 21, 1983, Schenker U.S. Pat. No. 4,310,044 issued Jan. 12, 1982, Schenker U.S. Pat. No. 4,382,461 issued May 10, 1983, Brabant U.S. Pat. No. 4,449,270 issued May 22, 1984, Catan U.S. Pat. No. 4,289,190 issued Sept. 15, 1981, Simon U.S. Pat. No. 4,335,777 issued June 22, 1982, Schenker et al. U.S. Pat. No. 4,186,790 issued Feb. 5, 1980, Sills U.K. Patent Application No. 2,080,379 published Feb. 3, 1982, and Klein Patentschrift DE No. 3,048,763, published June 9, 1983. Such doors are typically designed to open and close as rapidly as possible, to minimize damage in the event a vehicle should collide with the door, and to prevent unwanted loss or gain of heat through the doorway as much as possible.

Other types of flexible doors are also known. For example, Tohma U.S. Pat. No. 4,027,715 issued June 7, 1977, is illustrative of a door comprising a series of plate-like unit blocks or segments. Hinged flexible industrial doors are also known. See, for example, McGuire U.S. Pat. No. 3,750,739 issued Aug. 7, 1973, and Mackie British Patent Specifications No. 1,370,611 published Oct. 16, 1974 and No. 1,410,461 published Oct. 15, 1975. None of these other flexible doors are particularly well adapted for covering the entrance to a large industrial refrigerator or freezer, wherein both ease of access and good insulating properties are needed.

This invention provides a folding door which utilizes a specially designed curtain. One common type of curtain comprises a sheet, piece of fabric, or screen suspended on an overhead track by a series of hangers movably mounted in that track. See, for example, Sandall British Patent No. 1,554,159 published Oct. 17, 1979. Overlapping flexible sheets have also been used to provide a flexible wall, as illustrated by Johnson U.S. Pat. No. 3,561,518 issued Feb. 9, 1971. Ordinary curtains are not generally well adapted for use in industrial doors, since such curtains are generally cumbersome and lack thermal insulating properties.

The present invention provides an improved industrial door which is both highly insulated and capable of being opened and closed rapidly. The folding door according to the invention represents a distinct improvement over the hanging strip-type doors, such as the door of German Patent No. 3,048,763 noted above.

SUMMARY OF THE INVENTION

The present invention provides a folding door adapted for use in an industrial doorway, and a curtain for use in such a door. The curtain according to the invention has a plurality of separate insulated panel sections and at least one hinge section spanning the panel sections. The hinge section of the curtain is a flexible sheet which is thinner than the panels and is capable of being folded over itself. In the folding door according to the invention, this curtain hangs from an overhead suspension assembly. The folding door is actuated by a device which opens and closes the door by folding and unfolding the curtain. The hinge sections of the curtain allow it to close rapidly and do not greatly detract from the thermal insulating properties of the curtain.

BRIEF DESCRIPTION OF THE DRAWING

A preferred exemplary embodiment of the present invention will hereinafter be described in conjunction with the appended drawing, wherein like numerals denote like elements, and.

DETAILED DESCRIPTION OF A PREFERRED EXEMPLARY EMBODIMENT

Figure 1:
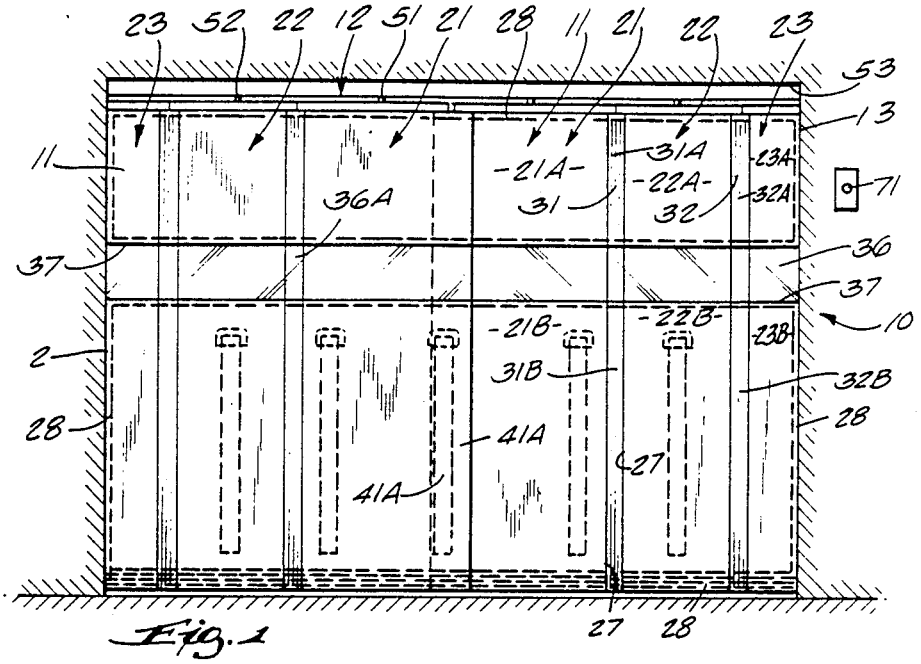
FIG. 1 is a front view of a folding door according to the invention.

FIGS. 1 through 4 illustrate a preferred embodiment of a folding door 10 according to the present invention. This folding door 10 includes a pair of folding curtains 11 each suspended from a suspension system 12 which spans the top of an industrial doorway 13. A pulley system 14 opens and closes the door by folding and unfolding respective curtains 11, as described in detail hereafter.

Figure 2:
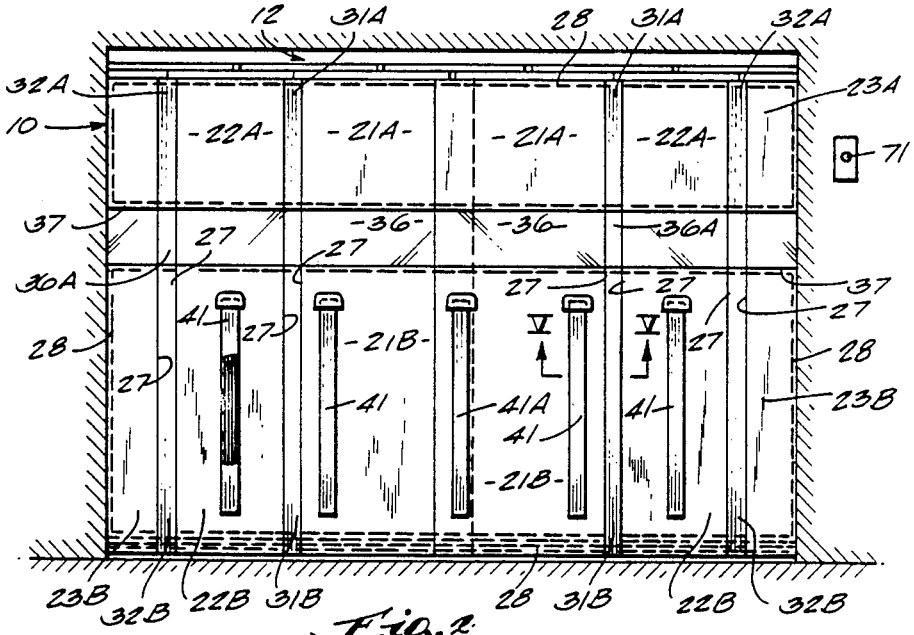
FIG. 2 is a rear view of the folding door shown in FIG. 1.
Figure 5:
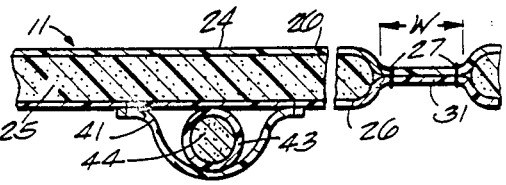
FIG. 5 is a sectional view along the line V—V in FIG. 2.
Figure 7:
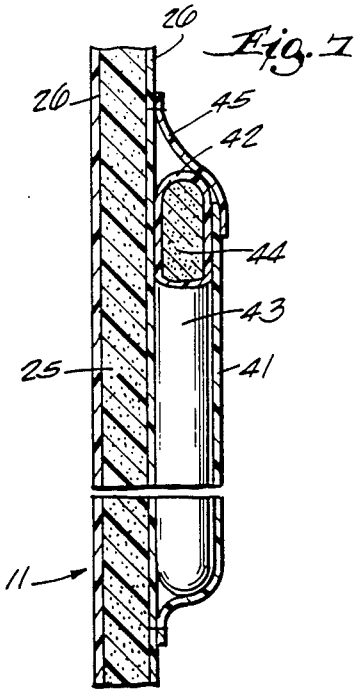
FIG. 7 is a sectional view taken along the line VII—VII in FIG. 6.
Figure 6:
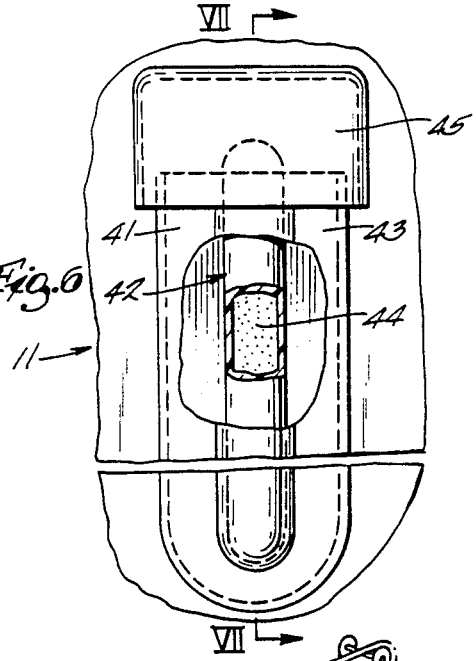
FIG. 6 is a partially broken away front view of a pocket containing a weight shown in FIG. 2.

As illustrated in FIGS. 1, 2 and 5, curtains 11 according to the present invention comprise a series of spaced-apart elongated, insulated panel sections, particularly an inner panel section 21, an intermediate panel section 22, and an outer panel section 23, and a pair of hinge sections 31 and 32, described below, which span adjacent panel sections 21–23. Each of panel sections 21–23 comprises a flexible cover 24 made of a pair of sheets 26, which cover 24 encloses a batt or layer of thermal insulation 25. Panel sections 21–23 preferably increase progressively in width towards the center of doorway 13. Outer panel section 23 typically is less than half as wide as panel sections 21, 22.

Inner panel sections 21 of each curtain 11 overlap each other at approximately the center of doorway 13 so that heat loss is prevented as much as possible. To eliminate such heat loss entirely, a single curtain 11 which extends across the entire doorway 13 can be employed, but such a single curtain 11 takes correspondingly longer to open and close than a pair of curtains 11 simultaneously folded using pulley system 14, as will be described in detail below.

Thermal insulation 25 can be sewn into curtain 11 between pair of sheets of fabric 26 along a pair of seams 27 which extend in the lengthwise direction of curtain 11. Thermal insulation 25 preferably comprises a batt of foam insulation, such as foam rubber. Cover sheets 26 are made of any suitable fabric, particularly a fabric impervious to moisture, such as nylon. Border seams 28 are sewn along outer edge portions of each curtain 11 to retain thermal insulation 25 therein and hold sheets 26 together.

Inner and outer hinge sections 31 and 32 respectively of curtain 11 are disposed between seams 27. In the embodiment shown, hinge sections 31, 32 are substantially the same as panel sections 21–23, except that thermal insulation 25 is omitted from hinge sections 31, 32 so that each hinge section 31, 32 comprises sheets 26 held together by seams 27 in face-to-face contact with each other.

The width W of hinge sections 31, 32 is particularly important in providing a curtain 11 useful in folding door 10. Panel sections 21–23 usually have widths of one foot or more, particularly width of at least two feet for inner panel sections 21, 22. Thermal insulation layers 25 typically have a thickness in the range of ½ to 2 inches. Hinge sections 31, 32 have a preferred width W of at least about 2 to 4 inches, particularly at least 3 inches. If the width W of hinge sections 31, 32 is less than 2 inches, folding door 10 will generally not close satisfactorily. If width W of the hinge sections 31, 32 is much greater than 4 inches, the insulating properties of the door will be diminished without further improving the foldability of curtain 11 to any significant extent. Hinge sections 31, 32 accordingly have a width W of at least about 2 inches. Hinge sections 31, 32 are not generally insulated, although thin, flexible insulation could be employed between sheets 26 in hinge sections 31, 32 in the embodiment shown. Hinge sections 31, 32 are substantially less thick than panel sections 21–23.

The ratio of the width W of hinge sections 31, 32 is directly related to the thickness of the insulation, since it is the additional bulkiness of the insulation which makes it difficult to fold curtain 11. Accordingly, it is preferred that the ratio of width W of hinge sections 31, 32 to the thickness of thermal insulation layers 25 be in the range of from 1:1 to 8:1, most preferably in the range of 2:1 to 4:1. For example, if insulation 25 is about one inch thick, hinge sections 31, 32 are preferably at least 3 inches wide.

Although hinge sections 31, 32 are shown in the illustrated embodiment as being defined by superposed sheets 26, such hinge sections 31, 32 could comprise a single such sheet 26. In such an embodiment, pieces of insulation 25 would be laid in spaced-apart positions on one sheet 26, and then a plurality of separate cover sheets would be sewn in place over each piece of thermal insulation 25, along seams 27.

Curtain 11 further preferably has a window 36 which comprises an elongated strip of transparent PVC plastic which spans curtain 11 laterally relative to the lengthwise direction of curtain 11, allowing a reasonably good view of the area beyond door 10 without unduly increasing the uninsulated surface of curtains 11. Window 36 subdivides panel sections 21–23 into upper and lower subsections 21A, 21B, 22A, 22B, 23A and 23B, respectively. Hinge sections 31, 32 are similarly subdivided into upper and lower subsections 31A, 31B, 32A, 32B, respectively by window hinge sections 36A. Window hinge sections 36A must have the ability to fold in the same manner as the rest of hinge sections 31, 32. Window 36 is sewn to subsections 21A–23A, 21B–23B, 31A, 31B, 32A and 32B by a pair of lateral seams 37.

Each of curtains 11 has a plurality of pockets 41 sewn to the back side thereof, as shown in FIG. 2. Pockets 41 are preferably located on the lower half of each curtain 11, particularly on lower panel subsections 21B, 22B. In the embodiment shown in FIGS. 1 and 2, lower panel subsection 21B has a pair of pockets 41 disposed near opposite side edges of subsection 21B, and lower panel subsection 22B has a single pocket 41 centrally located thereon. Each pocket 41 is elongated in the lengthwise direction of curtain 11, and preferably has a length of at least about one quarter, particularly about one third of the total length of curtain 11.

Each pocket 41 contains an elongated weight 42 disposed therein, which weight 42 preferably comprises a tubular sleeve of fabric such as canvas containing particulate matter or some other soft material, so that a vehicle accidentally colliding with folding door 10 is not damaged due to collision with heavy, hard weights, such as solid metal weights. Each weight 42 has substantially the same length as its associated pocket 41.

Each pocket 41 is open at the upper end thereof and is covered by a pocket cover flap 45 which overlaps an upper edge portion of pocket 41 from above, thereby preventing weight 42 from coming out of pocket 41 when folding door 10 is in use. As shown in FIG. 1, two innermost pockets 41A are substantially adjacent to each other at the overlapping portions of curtains 11 when folding door 10 is closed. This pocket and weight system is highly effective for preventing unwanted movement of curtains 11. In particular, vertically aligned weights 42 have been found more advantageous for this purpose than weights disposed horizontally, for example, along the bottom edge of curtain 11.

Any suitable means may be employed for suspending curtains 11 in doorway 13. One example of such a suspension system is disclosed by the above-cited German patent to Klein, No. 3,048,763, published June 9, 1983, the contents of which are incorporated by reference herein. The track and pulley system disclosed by this German patent can be used to effectively open and close curtains 11 according to the present invention.

Figure 3:
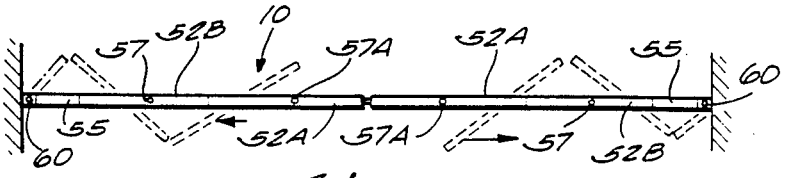
FIG. 3 is a top view of the folding door shown in FIG. 1, with a partially opened position shown in broken lines.
Figure 4:
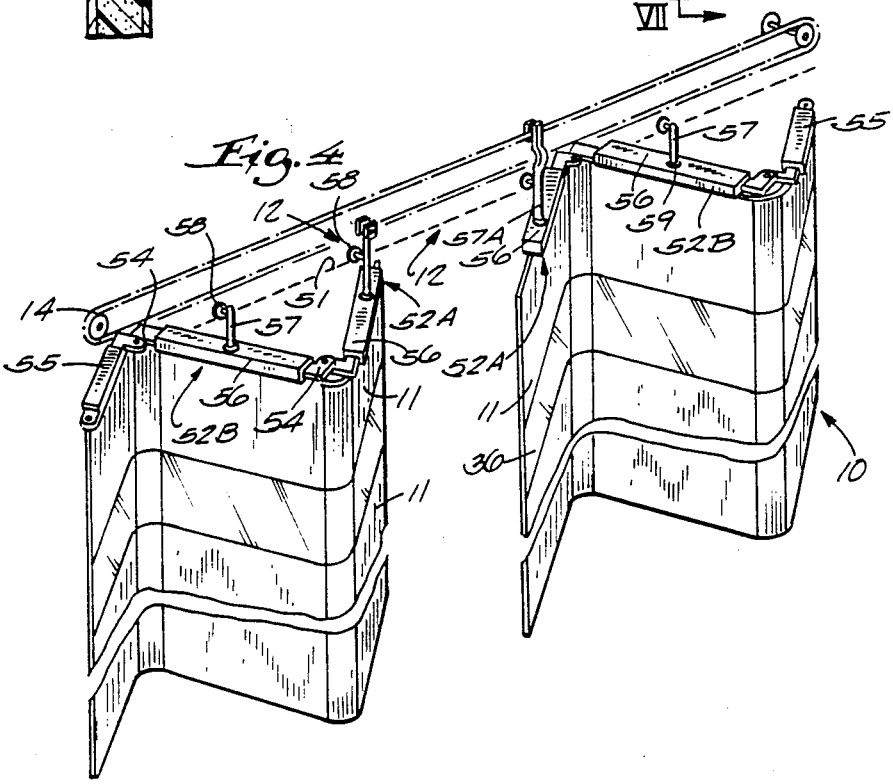
FIG. 4 is a perspective view of the folding door as shown in FIG. 3 together with the associated track and pulley system.

As shown in FIGS. 3 and 4, each curtain 11 is suspended from a track 51 by a pair of inner and outer hangers 52A, 52B respectively mounted for movement along track 51. Track 51 is securely mounted at or near top wall 53 of doorway 13, and preferably spans the entire width of doorway 13. Each hanger 52A, 52B typically comprises a horizontal bracket 56 secured to an upper edge portion of each of panel sections 21, 22. Any suitable conventional means, such as hooks or clamps (not shown) may be employed for securing upper panel subsections 21A, 22A of curtains 11 to each of horizontal brackets 56. Inner and outer hangers 52A, 52B are connected at adjacent ends thereof for pivotal movement relative to each other by a hinge 54. Outer hanger 52B is connected by a second hinge 54 to a pivoting arm 55 which is connected at one end thereof to a suitable wall bracket 60 mounted on the adjoining sidewall of doorway 13.

Each horizontal bracket (rack) 56 is connected to and suspended from a vertical support rod 57 which can, for example, be connected to and suspended from a roller assembly 58 mounted for horizontal rolling movement along track 51. Each support rod 57 is preferably rotatably secured through a hole 59 in the top of each horizontal bracket 56 so that horizontal bracket 56 may rotate relative to rod 57 as roller assembly 58 moves along track 51. Innermost horizontal brackets 56 have innermost support rods 57A connected at upper end portions thereof to pulley system 14, whereby innermost vertical rods 57A can be simultaneously drawn inwardly towards or outwardly away from the center of doorway 13.

Pulley system 14 moves rollers 58 along track 51 between a fully-extended (door closed) position as shown in FIGS. 1 through 3, a partially open position as shown in FIGS. 3 and 4, and a fully-closed position wherein each of hinge sections 31, 32 are folded substantially 180 degrees so that each of panels 21, 22, and 23 are collapsed into face-to-face contact with each other at opposite sides of the doorway. Pulley 14 can be actuated by any suitable means, such as an electric motor (not shown) connected to a wall switch 71 for opening and closing folding door 10. Wall switch 71 can be operated manually, or by conventional remote-control, such as by a short-range radio control signal. Switch 71 can include a sensor, such as an electric eye, for automatically opening and closing door 10 when the approach of a person or vehicle is detected by the sensor.

Operation of folding door 10 according to the foregoing embodiment of the invention is as follows. The door begins in the closed position shown in FIG. 1. A vehicle approaches folding door 10 and actuates switch 71. This causes the associated electric motor to turn on pulley system 14, which draws apart rods 57A. This causes each curtain 11 to collapse in the manner shown in FIG. 4. Folding occurs entirely at hinge sections 31, 32. Movement of roller assemblies 58 along track 51 rapidly opens folding door 10 fully. When folding door 10 is fully opened, panels 21–23 are folded upon each other like an accordion and turn about 90 degrees relative to the width of doorway 13. The vehicle may then pass through the doorway, whereupon the foregoing cycle is reversed in order to close the door again. The open-close sequence may be advantageously designed as a single cycle, so that actuation of switch 71 causes folding door 10 to open, remain open several seconds and then close automatically.

The folding door according to the present invention is substantially improved in comparison to hanging strip doors, since such hanging strip-type doors have poor insulating qualities due to the gaps between adjacent strips, even where adjacent strips overlap each other. Curtain 11 according to the invention solves this problem by means of specially designed hinge and panel sections which maximize the insulating qualities of the door while retaining the capacity to open and close rapidly like the strip-type doors. For example, a door 10 according to the foregoing embodiment, spanning a doorway ten or more feet in width, can open or close in as little as one second. Such features are particularly well-adapted for use in large industrial freezers or refrigerators, wherein vehicles must enter the refrigerator or freezer, deliver or load goods therein, and then leave the refrigerator or freezer.

It will be understood that the above description is of preferred exemplary embodiments of the present invention, and that the invention is not limited to the specific forms shown. For example, the number, width and size of insulated panel sections and hinge sections may be altered according to the characteristics of the doorway to be covered, although a design wherein the insulated panel sections progressively increase in width has been found especially advantageous for allowing the panels to fold more readily. These and other modifications may be made in the design and arrangement of the elements without departing from the scope of the present invention as expressed in the appended claims.

We claim:

1. A fan-foldable, insulated curtain, comprising:

a plurality of spaced-apart, elongated, insulated panel sections each comprising thermal insulation and a cover enclosing said insulation; and at least one hinge section spanning adjacent panel sections, said hinge section comprising a flexible sheet which is thinner than said panel sections, is capable of being folded over itself, and has a width at least as large as the thickness of said thermal insulation, further comprising at least one pocket disposed on at least one of said panel sections, and a weight disposed inside of said pocket, wherein said weight comprises an elongated, flexible tube filled with soft matter.

2. A fan-foldable, insulated curtain, comprising:

a plurality of spaced-apart, elongated, insulated panel sections each comprising thermal insulation and a cover enclosing said insulation; and at least one hinge section spanning adjacent panel sections, said hinge section comprising a flexible sheet which is thinner than said panel sections, is capable of being folded over itself, and has a width at least as large as the thickness of said thermal insulation, further comprising transparent means defining an elongated, flexible window in said curtain, said transparent means extending substantially laterally relative to the lengthwise direction of said curtain and partitioning each of said panel sections into pairs of upper and lower panel subsections.

3. A fan-foldable, insulated curtain, comprising:

a plurality of spaced-apart, elongated, insulated panel sections each comprising thermal insulation and a cover enclosing said insulation; and at least one hinge section spanning adjacent panel sections, said hinge section comprising a flexible sheet which is thinner than said panel sections, is capable of being folded over itself, and has a width at least as large as the thickness of said thermal insulation, wherein said curtain comprises at least three of said panel sections and at least two of said hinge sections therebetween, said panel sections being of progressively increasing width.

4. A folding door, comprising:

a fan-foldable, insulated curtain having a plurality of spaced-apart, elongated, insulated panel sections, each of said panel sections comprising a layer of thermal insulation enclosed by a cover, and at least one hinge section spanning adjacent panel sections, said hinge section comprising a flexible sheet which is thinner than said panel sections, is capable of being folded over itself and has a width at least as large as the thickness of said thermal insulation;

means for suspending said curtain in a doorway; and means for folding said door at said hinge section to open said door and for unfolding said door at said hinge section to close said door, further comprising at least one pocket disposed on at least one of said panel sections, and a weight disposed within each such pocket, said weight comprising an elongated flexible tube filled with soft matter.

5. The folding door of claim 4, wherein said pocket is elongated in the lengthwise direction of said curtain and said weight is elongated.

6. A folding door, comprising:

a fan-foldable, insulated curtain having a plurality of spaced-apart, elongated, insulated panel sections, each of said panel sections comprising a layer of thermal insulation enclosed by a cover, and at least one hinge section spanning adjacent panel sections, said hinge section comprising a flexible sheet which is thinner than said panel sections, is capable of being folded over itself and has a width at least as large as the thickness of said thermal insulation;

means for suspending said curtain in a doorway; and means for folding said door at said hinge section to open said door and for unfolding said door at said hinge section to close said door, said door further comprising a flexible transparent window disposed across said curtain extending substantially laterally relative to the lengthwise direction of said curtain and partitioning each of said insulated panel sections into pairs of upper and lower panel subsections.

7. A folding door, comprising:

a continuous insulated curtain having a plurality of spaced-apart, elongated, insulated panel sections, each of said panel sections comprising a layer of thermal insulation enclosed by a moisture impervious cover, at least one of said panel sections having a pocket disposed thereon elongated in the lengthwise direction of said curtain and containing a weight disposable therein, which weight comprises an elongated flexible tube filled with soft matter, and at least one hinge section spanning adjacent panel sections, said hinge section comprising a flexible sheet which is thinner than said panel sections, is capable of being folded over itself, and has a width at least as large as the thickness of said thermal insulation;

a track securable across the top of a doorway;

a plurality of hangers mounted on said track for movement along said track, each of said hangers being secured to one of said panel sections so that said curtain depends from said hangers and said door can be folded to an open position by movement of said hangers along said track; and a pulley system connected to effect reversible movement of said hangers along said track.

* * * * *